US005970271A

United States Patent [19]

Clough

[11] Patent Number: 5,970,271

[45] Date of Patent: Oct. 19, 1999

[54] SPOOL CADDY FOR USE WITH DRY OPTICAL IMAGE PROCESSING OF ROLL FILM

[75] Inventor: Arthur H. Clough, Hardwick, Mass.

[73] Assignee: Polaroid Corporation, Cambridge, Mass.

[21] Appl. No.: 09/038,506

[22] Filed: Mar. 11, 1998

Related U.S. Application Data

[60] Provisional application No. 60/040,662, Mar. 11, 1997.

[51] Int. Cl.[6] ..... G03D 13/14; G03D 13/08; B65D 85/48

[52] U.S. Cl. ..... 396/648; 396/647; 206/455

[58] Field of Search ..... 396/33, 604, 606, 396/612, 620, 647, 623, 648; 355/27–29; 206/455

[56] References Cited

U.S. PATENT DOCUMENTS

| | | | |
|---|---|---|---|
| 2,558,857 | 7/1951 | Land | 396/33 |
| 3,345,165 | 10/1967 | Land | 430/404 |
| 3,380,679 | 4/1968 | Komas et al. | 242/422 |
| 3,416,921 | 12/1968 | Coenen | 430/206 |
| 3,576,632 | 4/1971 | Bornemisza | 430/404 |
| 3,615,482 | 10/1971 | Cronig | 430/456 |
| 3,647,464 | 3/1972 | Smith | 430/232 |
| 3,680,462 | 8/1972 | Cronig | 396/606 |
| 3,681,254 | 8/1972 | Becker | 430/404 |
| 3,689,272 | 9/1972 | Schwan et al. | 430/206 |
| 3,816,136 | 6/1974 | Goffe et al. | 430/405 |
| 3,826,653 | 7/1974 | Jacobs et al. | 430/206 |
| 3,907,563 | 9/1975 | Land | 430/206 |
| 3,930,859 | 1/1976 | Corrigan | 430/404 |
| 4,309,100 | 1/1982 | Bendoni et al. | 396/604 |
| 4,370,045 | 1/1983 | Holmes | 396/585 |
| 4,452,523 | 6/1984 | Douglas | 396/33 |
| 4,605,608 | 8/1986 | Bullitt | 430/206 |
| 5,200,295 | 4/1993 | Vermeulen et al. | 430/206 |
| 5,229,246 | 7/1993 | Shibata et al. | 430/217 |
| 5,325,144 | 6/1994 | Yoshikawa et al. | 396/612 |
| 5,440,366 | 8/1995 | Reiss et al. | 396/33 |
| 5,450,160 | 9/1995 | Tianello et al. | 396/564 |
| 5,473,402 | 12/1995 | Long et al. | 396/620 |
| 5,478,703 | 12/1995 | Simons | 430/383 |

FOREIGN PATENT DOCUMENTS 0 800 114 A2 10/1997 European Pat. Off. .

*Primary Examiner*—D. Rutledge
*Attorney, Agent, or Firm*—Leslie Payne

[57] ABSTRACT

A spool caddy for use with an optical dry image processor for processing a photographic roll film housed in a film cartridge includes: a plurality of processing spools, each containing a reagent laden pad for providing a processing step when combined with an emulsion side of the film for a predetermined dwell time; and a structure for detachably securing and supporting each processing spool in isolation from one another. The structure can also accommodate the film cartridge. One end of each processing spool and the film is attached to the structure.

18 Claims, 11 Drawing Sheets

SPOOL CADDY FOR USE WITH DRY OPTICAL IMAGE PROCESSING OF ROLL FILM

CROSS-REFERENCE TO RELATED APPLICATIONS

This application claims the benefit of co-pending United States provisional application serial No. 60/040,662 entitled "Spool Caddy For Use With Dry Optical Image Processing of Roll Film" filed on Mar. 11, 1997.

BACKGROUND OF THE INVENTION

1. Field of the Invention

This invention is directed generally towards an apparatus and method for use in dry processing any photographic roll film, and more particularly towards a spool caddy for use with a system, such as the system disclosed in Polaroid Case No. 8221, entitled "System for Optical Dry Processing of Spooled Photographic Film", having United States provisional application serial No. 60/040,388 filed on Mar. 11, 1997 and also filed as an utility patent application even date herewith, for pad processing of photographic roll film, such as 35 mm film.

2. Description of the Prior Art

Pad processing is a well known dry optical image processing technique for processing a photographic film using webs, also known as pads, which contain processing fluids. Pad processing is considered a dry processing technique since liquid chemical baths are replaced with reagent laden webs which have been imbibed with processing chemicals. Sometimes a pad is saturated with processing chemicals and at other times, the processing chemicals are stored in a rupturable pod. When the pod is ruptured, the processing chemicals are spread across the web as a first step towards film development.

In U.S. Pat. No. 5,440,366 issued Aug. 8, 1995 to Reiss and Cocco, a system and method are disclosed whereby individual processing pads are sequentially wrapped onto a single processing spool. One embodiment discloses a processing spool which houses all the processing webs such as: a first reagent laden web which could be imbibed, for instance, with developing chemicals; a second reagent laden web which could be imbibed, for instance, with bleaching and fixing chemicals; and a third reagent laden web which could be imbibed, for instance, with washing and stabilizing chemicals. A photographic film is housed in a separate standard 35 mm cartridge. The first web is combined with the film for a first preset time, then the first web and the film are separated and the second web and the film are combined for a second preset time, then the second web and the film are separated and the third web and the film are combined for a third preset time. After the third web and the film are separated, the optical processing of the photographic film is complete. An alternative embodiment uses a standard size 35 mm cartridge for housing both the processing webs and the photographic film. However, the standard size 35 mm cartridge limits the number of exposures available from such a combined web/film spool. If the cartridge was made larger to hold more exposures, then it would not fit into a standard 35 mm camera. Also, the complete separation or isolation of each processing web from one another and from the film is quite difficult.

The above and other disadvantages of existing processing systems are overcome through the use of a spool caddy built in accordance with the principles of the invention for use with a dry optical image processing system. The spool caddy isolates processing spools from one another, and supports both the film cartridge and a multitude of processing spools during processing.

SUMMARY OF THE INVENTION

A spool caddy for use with an optical dry image processor for processing a photographic roll film housed in a film cartridge includes: a plurality of processing spools, each containing a reagent laden pad for providing a processing step when combined with an emulsion side of the film for a predetermined dwell time; and a structure for detachably securing and supporting each processing spool in isolation from one another. The structure can also accommodate the film cartridge. One end of each processing spool and the film is attached to the structure.

BRIEF DESCRIPTION OF THE DRAWINGS

The aforementioned aspects and other features of the invention are described in detail in conjunction with the accompanying drawings, not drawn to scale, in which the same reference numerals are used throughout for denoting corresponding elements and wherein.

DETAILED DESCRIPTION OF THE PREFERRED EMBODIMENT

Figure 1:
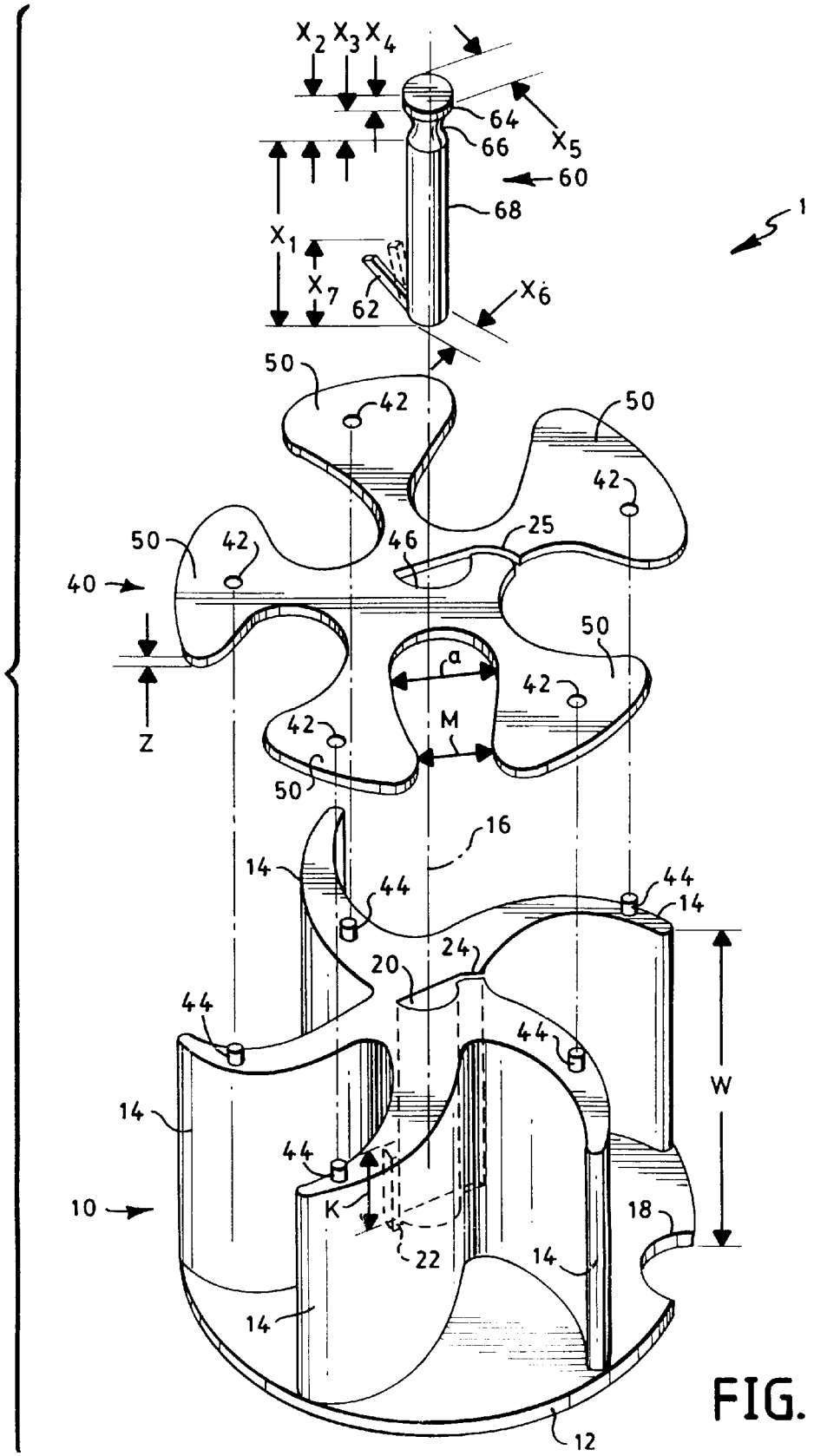
FIG. 1 is a perspective exploded view of a first embodiment of a spool caddy having a body, a snap plate and a binding lever for use during dry optical image processing of roll film.

FIG. 1 is a perspective exploded view of a first embodiment of a spool caddy 1 which conforms to the principles of the present invention. The three major components of the spool caddy 1 are the body 10, the snap plate 40 and the binding lever 60. Each of the major components is preferably molded or otherwise made from a strong, inexpensive, lightweight material such as polystyrene or any other plastic. These components when assembled together form the spool caddy 1, shown with a single processing spool 80 in FIG. 2.

Figure 2:
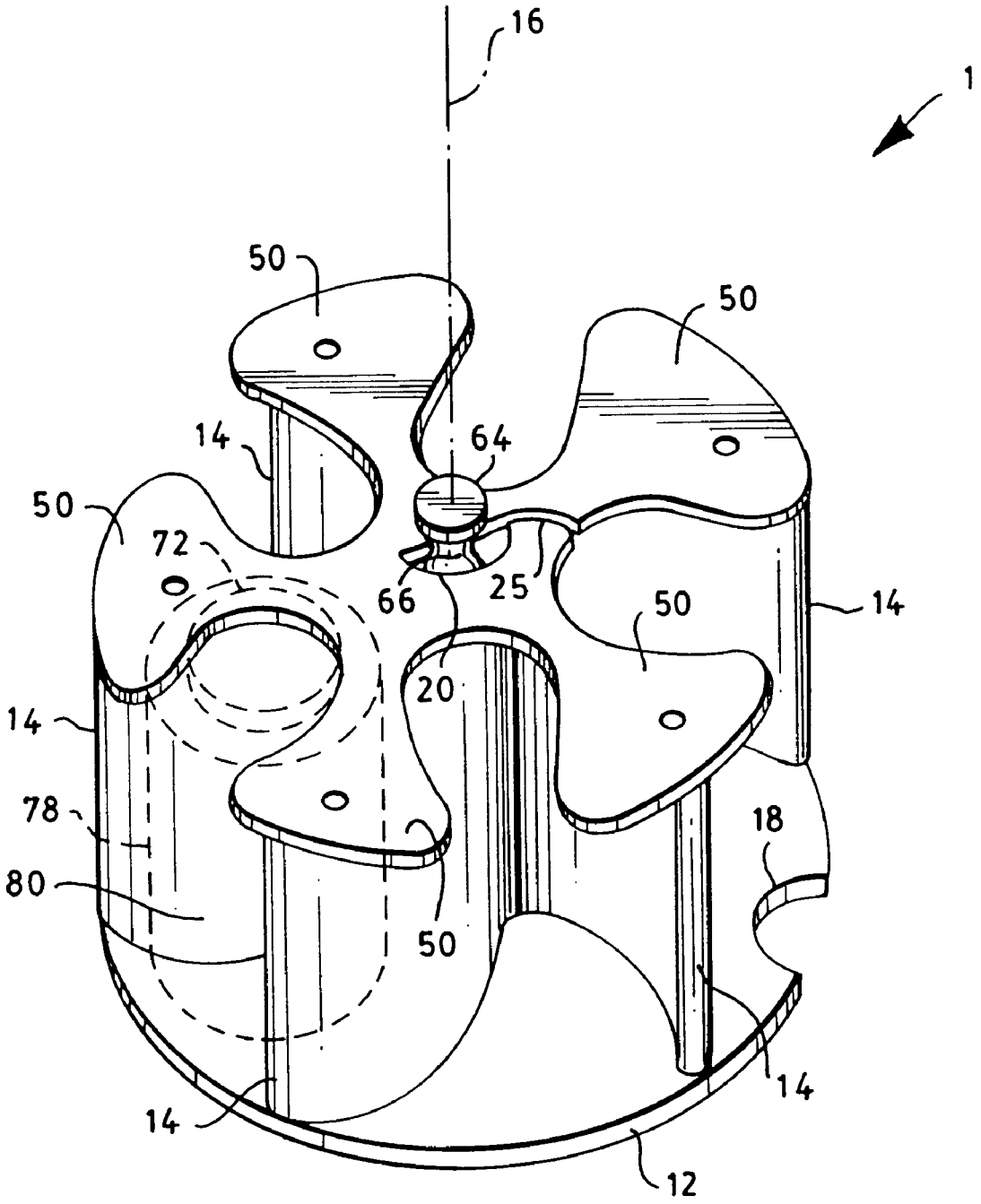
FIG. 2 is a perspective view of the assembled spool caddy of FIG. 1 with a single processing spool installed.
Figure 3A:
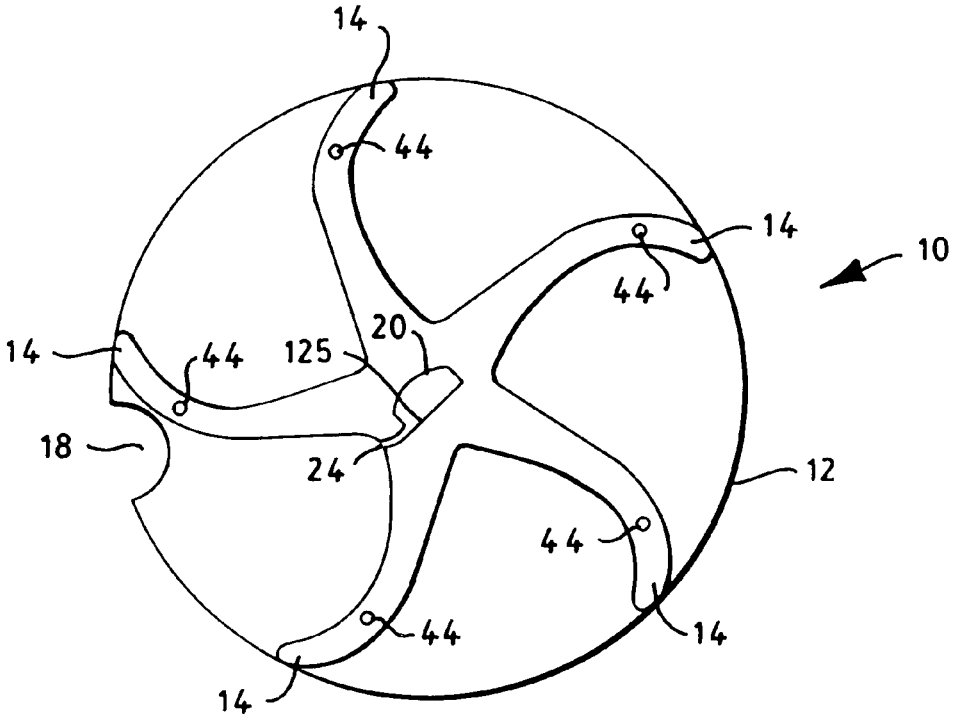
FIG. 3A is a top view of the body of the spool caddy of FIG. 1.
Figure 3C:
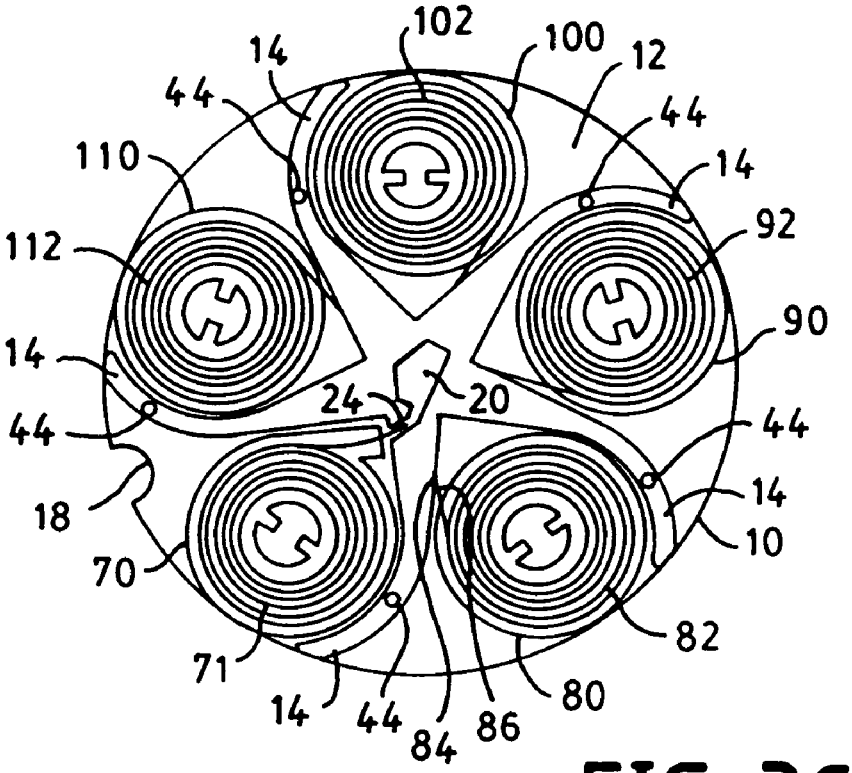
FIG. 3C is a top view of the body of the spool caddy of FIG. 1 having both processing spools and a photographic roll film cartridge supported thereon.
Figure 6A:
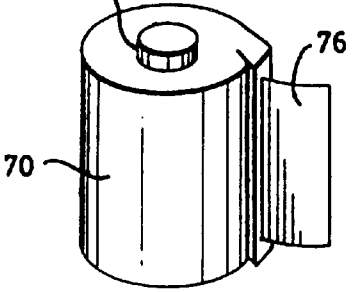
FIG. 6A is a perspective view of a photographic film cartridge for use with the spool caddy of FIG. 1.
Figure 6B:
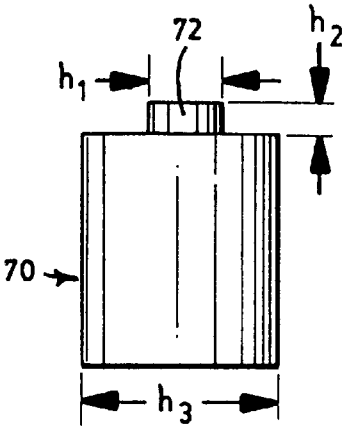
FIG. 6B is a side view of a photographic film cartridge for use with the spool caddy of FIG. 1.
Figure 6C:
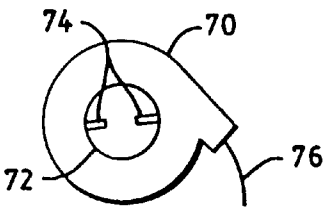
FIG. 6C is a top view of a photographic film cartridge for use with the spool caddy of FIG. 1.
Figure 10:
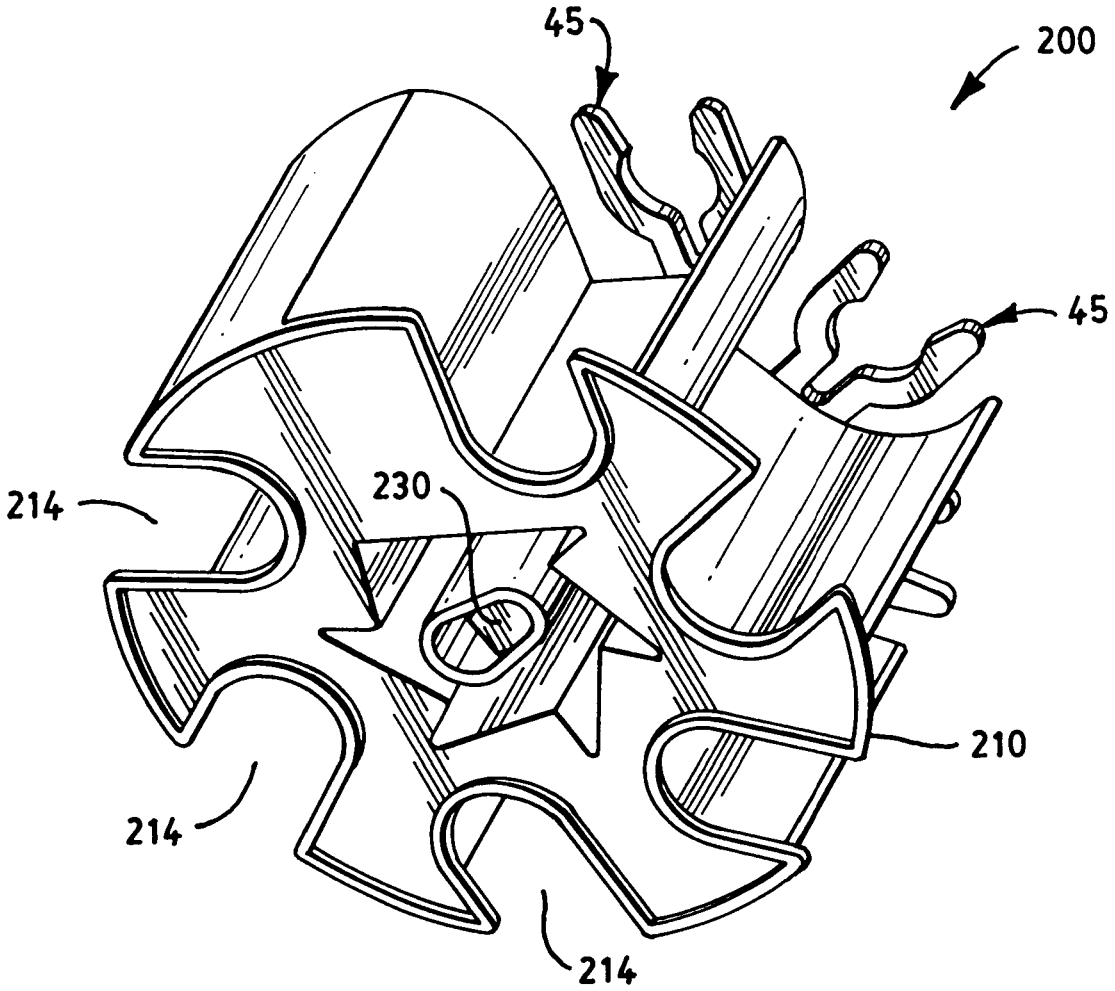
FIG. 10 is a bottom side perspective view of the spool caddy of FIG. 8.
Figure 11:
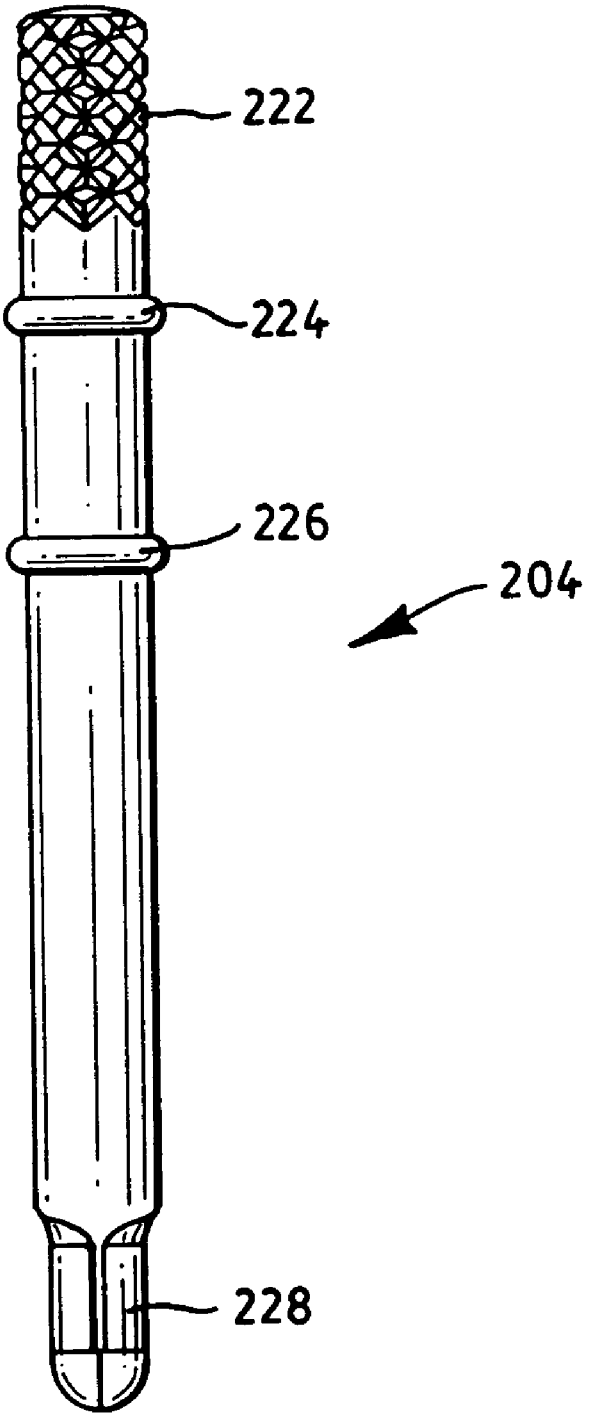
FIG. 11 is a side view of a preferred embodiment of a binding lever for use with the spool caddy of FIG. 8.

The body 10 acts as means, as shown in FIG. 3C, for detachably securing and supporting a number of processing spools 80, 90, 100, 110, as well as the film cartridge 70, in isolation from one another. The body 10 includes a base 12, a plurality of arms 14 and a wedge shaped cavity 20 positioned along the central longitudinal axis 16 of the spool caddy 1. The cavity 20 is indexed, notched or keyed in a lower section of the body by a rectangular notch 22. Moreover, a slot 24 for engaging a film leader 76 of the film cartridge 70 (see FIGS. 3C and 6A) extends from the cavity 20 as shown. The body 10 is keyed by a notch 18 as shown in FIG. 2 which acts as a means for enabling positional alignment of the spool caddy 1 in relation to other components of a pad processing system (not shown). Other known means for positional alignment of the spool caddy I can be used if desired. For instance, the spool caddy 200 of FIGS. 8 and 9 can be aligned with any external structure (not shown) via a keyed binding lever 204 as shown in FIG. 11. The binding lever 204 includes a knurled top section 222, a retaining ring 224, an annular rib 226 and a lower section 228. The lower section 228 in this case is oval shaped for a snug fit into the lower section 230 (see FIG. 10) of the cavity 212. The section 228 is designed to extend beyond the plane of the base 210 for cooperation with an appropriately shaped receptacle in an external structure, so that the spool caddy 200 will be keyed, i.e. positionally aligned, to the external structure.

Turning back to the spool caddy 1 of FIGS. 1 and 2, the snap plate 40, having a thickness "z", includes a centrally located cavity shaped opening 46 similar in shape to the cavity 20 of the body 10, as well as a slot 25 corresponding to the slot 24 of the body 10. The snap plate 40 functions as means for detachably retaining or holding both a plurality of processing spools, such as the processing spool 80 of FIG. 2, and the film cartridge 70 of FIG. 6A. The snap plate 40 may be clover shaped as shown in FIGS. 1 and 2, or its shape could vary as shown by the snap plate 140 of FIG. 4, as long as it has the ability to detachably retain processing spools and film cartridges.

The snap plates 40 and 140 are both capable of detachably holding five spools, although the snap plates could be designed in cooperation with the spool caddy 1 to retain more or less spools if desired. The snap plate 40 of FIG. 2 includes five identical leaf shaped sections 50 defining five identical spaces therebetween, each space having a cross-sectional distance "a" and a narrow region of distance "m" at the perimeter of the snap plate 40. Similarly, the snap plate 140 of FIG. 4 includes five claw shaped arms 45 each having a pair of claws 49 and 51 which also define five identical spaces therebetween each having a cross-sectional distance "a" and a narrow distance "m" located near the ends of the claws. The snap plate 40 or 140 and the body 10 can be glued together, snapped together, screwed together, or otherwise held together by any known fastening means. The embodiment of FIG. 1 provides clearance holes 42 in the snap plate 40 and raised bosses 44 on the body 10 which allows the two parts to be joined together by ultrasonic staking to form the body/snap plate assembly. The snap plate 140 of FIG. 4 includes clearance holes 43 which would be aligned with appropriately positioned raised bosses (not shown) replacing the bosses 44 on the body 10.

Figure 4:
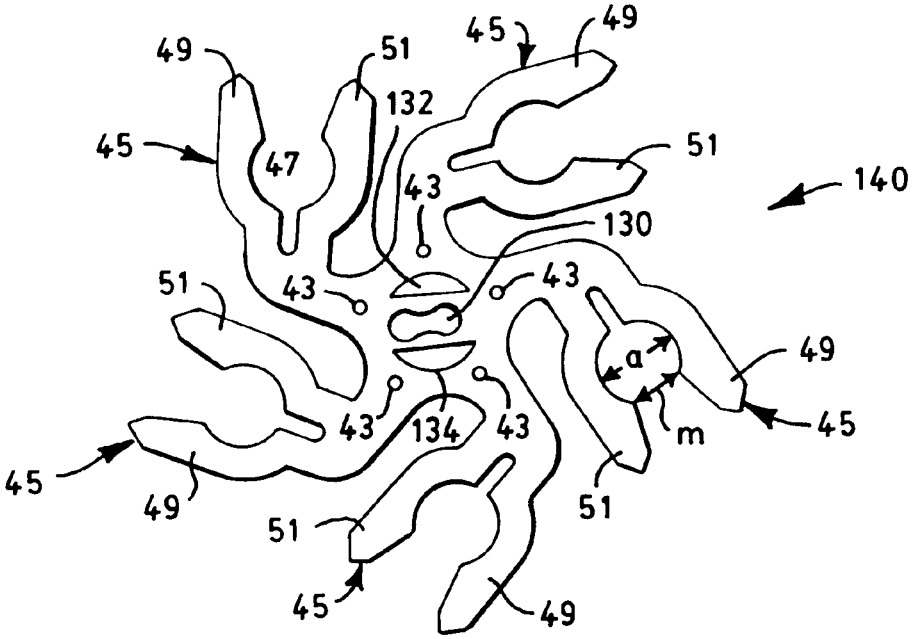
FIG. 4 is a top view of a second embodiment of a snap plate for use with the spool caddy of FIG. 1.
Figure 5C:
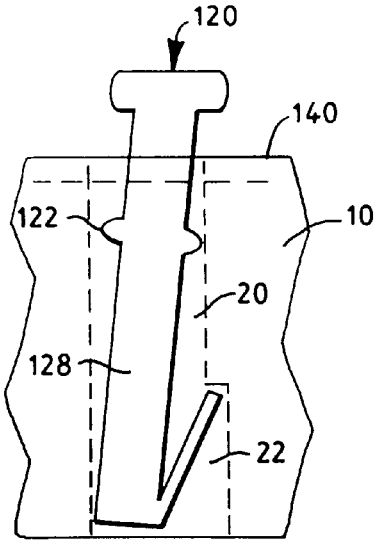
FIG. 5C is a cross-sectional side view of the binding lever of FIG. 5A in the unlocked position in the spool caddy of FIG. 1.
Figure 5D:
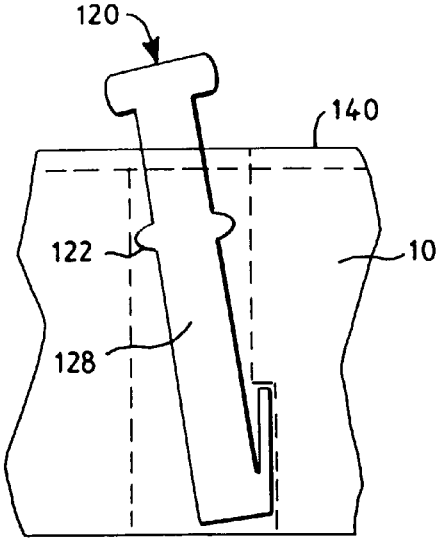
FIG. 5D is a cross-sectional side view of the binding lever of FIG. 5A in the locked position in the spool caddy of FIG. 1.
Figure 5A:
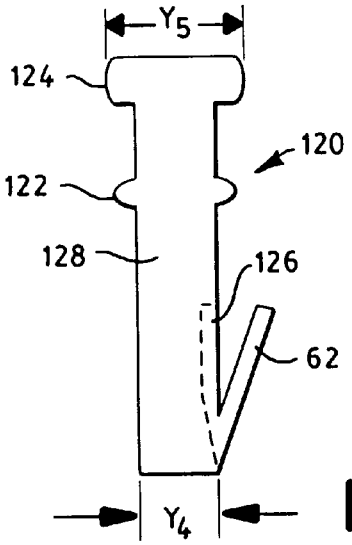
FIG. 5A is a side view of a second embodiment of a binding lever for use with the spool caddy of FIG. 1 in conjunction with the snap plate of FIG. 4.
Figure 5B:
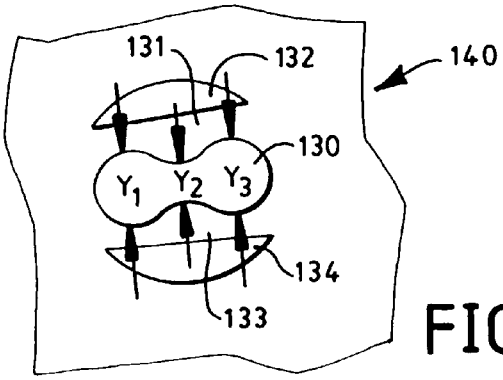
FIG. 5B is a magnified top view of a centrally located section of the snap plate of FIG. 4.

The snap plate 140 also includes centrally located cutouts 130, 132 and 134 as illustrated in FIGS. 4 and 5B. The cutout 130 is an hour glass shaped opening defined by distances $y_1$, $y_2$ and $y_3$, where $y_1=y_3=y_4$, $y_4<y_1$ and $y_4>y_2$ (see also FIG. 5A). Cutout 134 is separated from the cutout 130 by a section 133, and cutout 132 is separated from the cutout 130 by a section 131.

The binding lever 60 is designed as a means for detachably retaining, in cooperation with the body 10, a film leader 76 of the film 71. First, the film leader 76 is inserted into the cavity 20 of the caddy body 10, then the binding lever 60 is inserted through the top of the body/snap plate assembly so that the spring 62 is aligned with, and snaps into, the notch 22. The diameter $x_5$ of the head 64 of the binding lever 60 is large enough so that the head 64 can not pass into or through the cavity 20. Also, the force of the spring 62 pushes the spring 62 against the internal wall of the notch 22 to securely bind the lever 60 in the cavity 20. Hence, once the binding lever 60 is inserted into the cavity 20 it cannot be removed. After insertion of the binding lever 60, the head 64 and the indent 66 of the binding lever 60 will both protrude above the snap plate 40 as shown in FIG. 2 to act in cooperation as a handle for inserting and removing the spool caddy I from a pad processing system.

The binding lever 60 of FIG. 1 includes: a shaft 68 of diameter $x_6$ and height $x_1$; an indent 66 of length $x_3$; a head 64 having a diameter $x_5$ and a thickness $x_4$; and a spring 62 of length $x_7$ having a spring force which tends to extend the spring 62 away from the shaft 68 as shown. When a force is applied to the spring 62 to bring it nearly parallel with the longitudinal axis 16 of the shaft 68 (shown by dotted lines), the length $x_7$ defines the distance from the bottom of the shaft 68 to the top end of the spring 62. The length $x_7$ also corresponds to the length "k" of the notch 22 located adjacent to the lower portion of the cavity 20 in the caddy body 10. The distance $x_1$ of the shaft 68 of the binding lever 60 equates to the sum of the height "w" of the caddy body 10 and the width "z" of the snap plate 40 so that when the spool caddy 1 is completely assembled as shown in FIG. 2, the shaft head 64 and the indent 66 both protrude above the snap plate 40.

Once the spool caddy 1 is assembled as shown in FIG. 2, any movement of the binding lever 60 in a direction crossing the central longitudinal axis 16 of the spool caddy 1 is hampered by the force of the spring 62. Furthermore, any movement of the binding lever 60 in a direction parallel to the longitudinal axis 16 is hampered by both the head 64 and the physical engagement of the spring 62 within the notch 22.

Figure 3B:
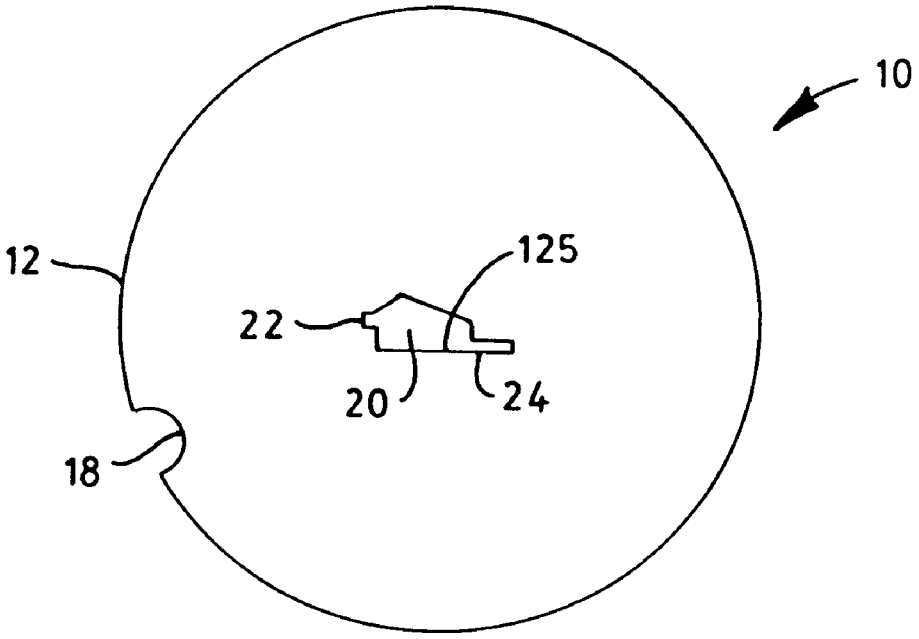
FIG. 3B is a bottom view of the body of the spool caddy of FIG. 1.

When the user decides to process the film within a 35 mm film cartridge 70 using a spool caddy 1 having a snap plate 40 and a binding lever 60, he first feeds the film leader 76 into the slot 24 of the caddy body 10 and along the flat surface 125 of the cavity 20 (see FIGS. 2, 3B and 3C). Next, the binding lever 60 is inserted as described above so that the spring 62 snaps into the notch 22 and the film leader 76 becomes bound between the shaft 68 and the flat surface 125 in the cavity 20. The film cartridge 70 is then detachably secured onto the spool caddy 1 by snapping the core 72 of the film cartridge 70 into the clover leaf shaped snap plate 40. In order to release the film leader 76, the user laterally applies pressure to the head 64 of the binding lever 60 so that the shaft 68 moves slightly away from the flat surface 125.

A second type of binding lever 120 for use with the snap plate 140 of FIG. 4 is shown in side view in FIG. 5A. The binding lever 120 includes a shaft 128 having a cutout section 126. The shaft 128 has a diameter $y_4$, and further includes an annular rib 122 having a diameter greater than $y_4$. The binding lever 120 is designed to operate in cooperation with the cutout section 130 of the snap plate 140 (see FIGS. 4 and 5B). The binding lever 120 is placed in an initial unlocked position as shown in FIG. 5C by inserting lever 120 through $y_3$ of the cutout 130 and into the body/snap plate assembly from the top until the spring 62 snaps into place within the notch 22.

Figure 8:
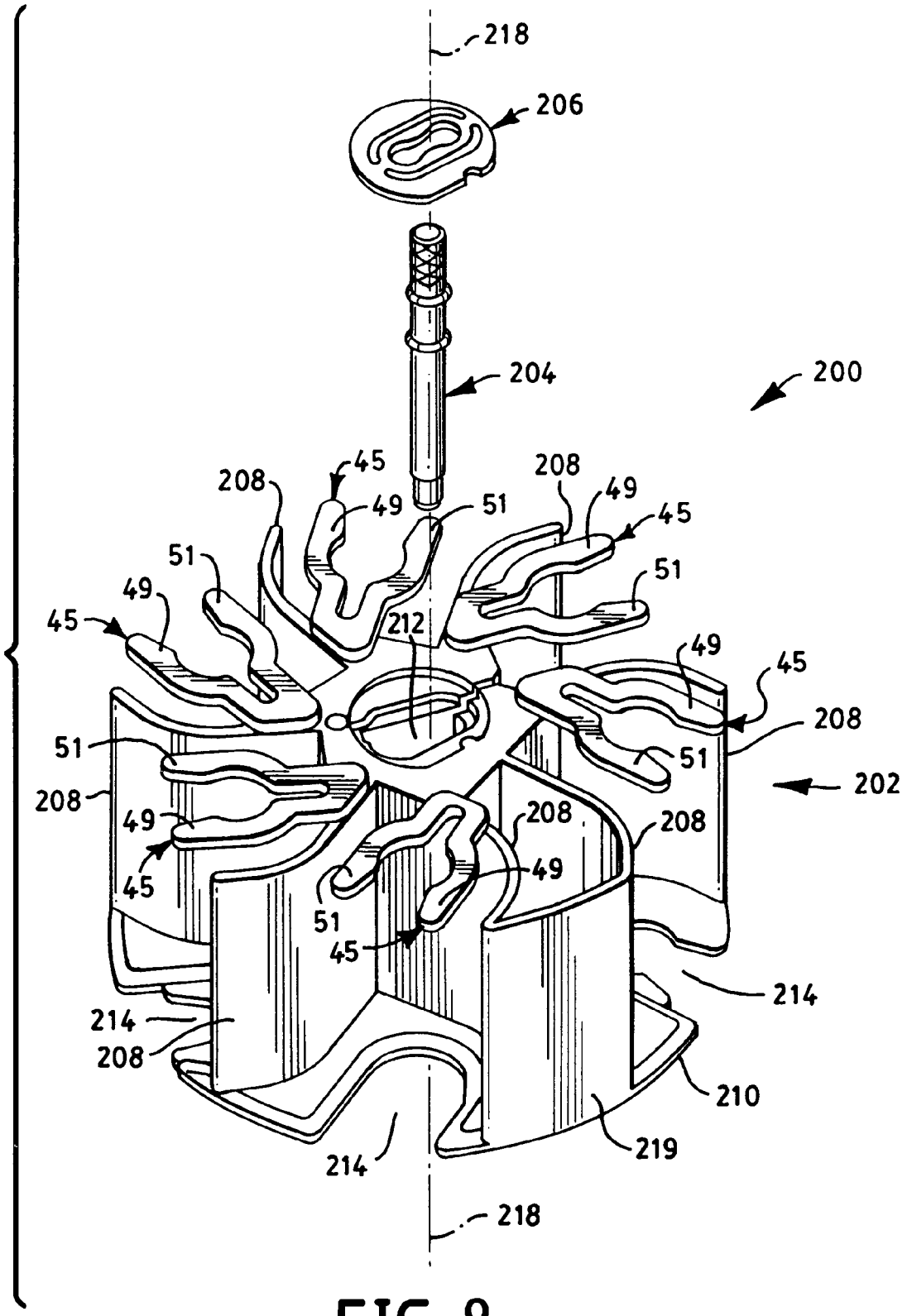
FIG. 8 is a perspective exploded view of a second embodiment of a spool caddy having a body, a snap ring and a binding lever for use during dry optical image processing of roll film.
Figure 9:
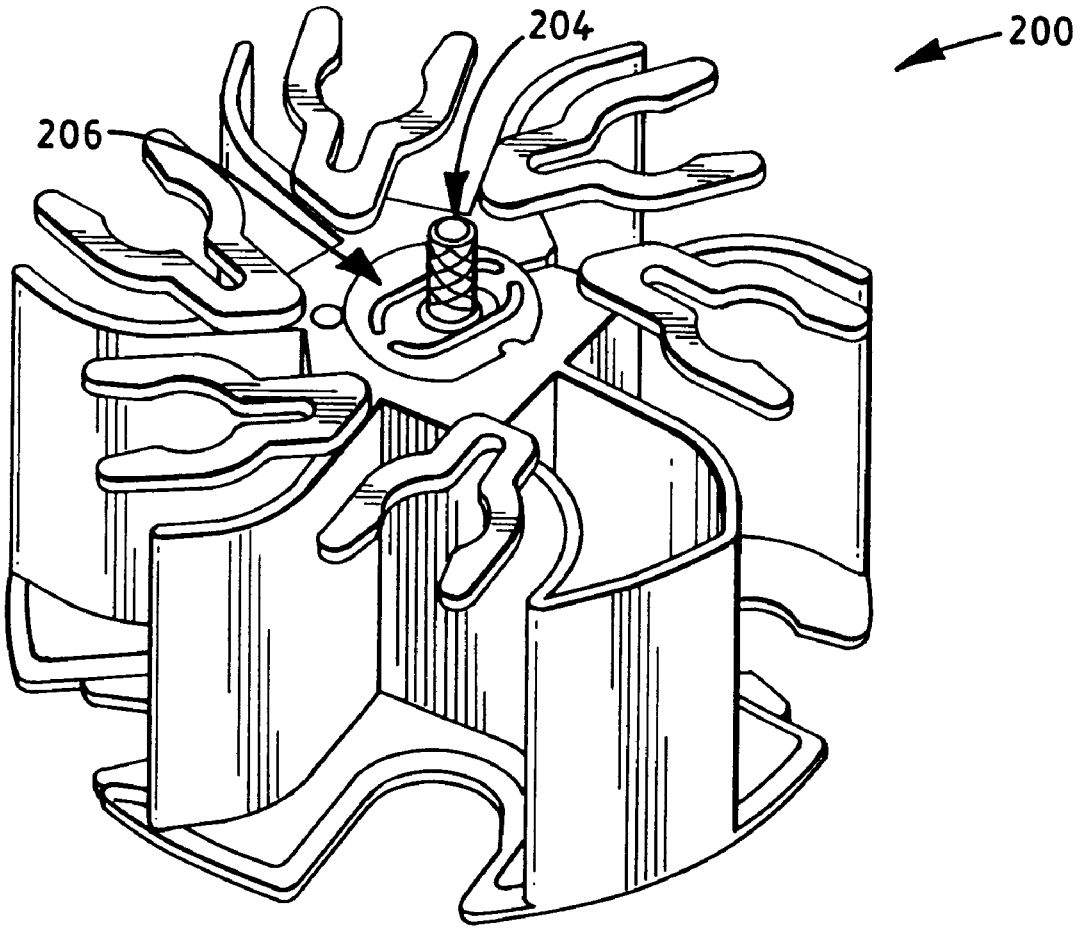
FIG. 9 is a top side perspective view of the assembled spool caddy of FIG. 8.

The binding lever 204 of FIG. 11 for use with the spool caddy 200 of FIG. 8 has an annular rib 226 which functions in the same manner as the annular rib 122 of the binding lever 120 shown in FIGS. 5A, 5B and 5C. The top section 222 is knurled for ease in gripping by the user. The lower section 228 extends beyond the plane of the base 210 of the spool caddy 200 for cooperation with an appropriately shaped receptacle in an external structure (not shown) for positional alignment of the spool caddy 200. The retaining ring 224 functionally replaces the spring 62 (see FIG. 5A) by securing the binding lever 204 in the slot 212. Specifically, the spool caddy 200 is assembled (without the spools installed) as shown in FIGS. 8 and 9 by inserting the binding lever 204 into the cavity 212 of the body 202, then overlaying the snap ring 206 and attaching (e.g. by gluing, snap-fitting, heat sealing, etc.) the snap ring 206 onto the body 202. The retaining ring 224 thereafter prevents removal of the binding lever 204 from the body 202.

When the user decides to process a 35 mm film cartridge 70 using the spool caddy 1 of FIG. 1 having a snap plate 140, first, he feeds the film leader 76 into the slot 24 of the caddy body 10 and into engagement with the flat surface 125 in the cavity 20. Then, he inserts the binding lever 120 into the unlocked position of FIG. 5C so that the film leader 76 is loosely positioned in the cavity 20 between the flat surface 125 and the shaft 128. The user then applies a lateral force to the head 124 of the binding lever 120 so that the binding lever 120 is shifted and snapped into the locked position shown in FIG. 5D, whereby the film leader 76 is securely fastened in the cavity 20 between the flat surface 125 and the shaft 128. When pushing the binding lever 120 into the locked position, the binding lever 120 passes from $y_3$ (see FIG. 5B) through the region $y_2$ of the cutout 130 and into the locked position of FIG. 5D corresponding to the region $y_1$ of the cutout 130. When the binding lever 120 passes through the region $y_2$ of the cutout 130, the sections 131 and 133 will slightly bend away from the cutout 130 and into the respective cutouts 132 and 134, thus momentarily expanding the distance $y_2$ to allow passage of the binding lever shaft 128. After passage of the binding lever 60, the sections 131 and 133 resiliently return to their original positions. The resultant locked position of the binding lever 120 is illustrated in FIG. 5D whereby the annular rib 122 is bound upon the inner surface 125 of the cavity 20 with the film leader 76 secured therebetween (not shown). Once the film leader 76 is secured within the cavity 20, the film cartridge 70 can be detachably secured onto the spool caddy 1 by snapping the core 72 of the film cartridge 70 between two claws 49 and 51 of the snap plate 140.

The film leader 76 can be readily removed from the binding lever 120 by moving the binding lever 120 into its unlocked or release position. This is accomplished by pushing the head 124 of the binding lever 120 from $y_1$ through $y_2$ and into $y_3$, as viewed in FIG. 5B, whereby the film leader 76 is then loosely positioned between the annular rib 122 of the shaft 128 and the flat surface 125 to facilitate removal therefrom.

Figure 7A:
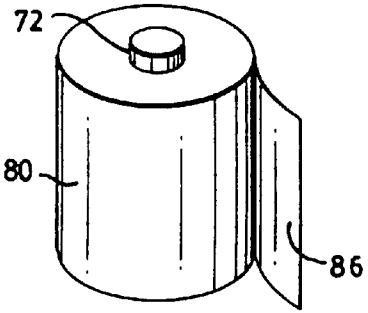
FIG. 7A is a perspective view of a processing spool for use with the spool caddy of FIG. 1.
Figure 7B:
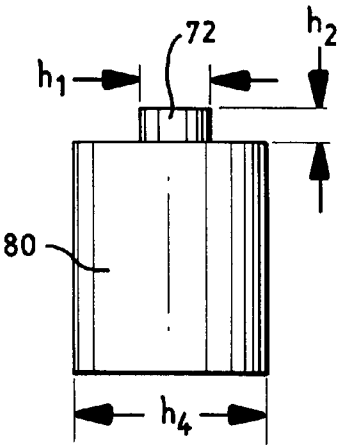
FIG. 7B is a side view of a processing spool for use with the spool caddy of FIG. 1.
Figure 7C:
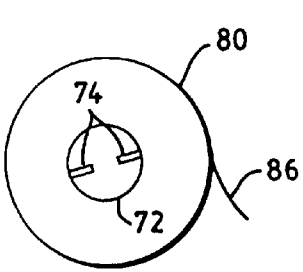
FIG. 7C is a top view of a processing spool for use with the spool caddy of FIG. 1.

The processing spools 80, 90, 100 and 110 of the current embodiment are each factory installed into the spool caddy 1 in the same manner in which processing spool 80 is shown to be installed in FIG. 2. Each processing spool as well as a standard 35 mm film cartridge 70 contains a hollow core 72 with dual drive tangs 74 recessed therein (see FIGS. 6A, 6B, 6C, 7A, 7B and 7C) for transferring rotational drive force from a source (not shown) to the core 72. The structure and dimensions of each processing spool 80, 90, 100 and 110 is similar to that shown in FIGS. 7A, 7B and 7C. Each processing spool and film cartridge contains a core 72 of diameter $h_1$ which protrudes from one end of the body of the spool or cartridge by a height $h_2$.

The spool caddy 1 is designed to accommodate any 35 mm film cartridge or processing spool by snapping the core 72 through the appropriate narrow region "m" of the snap plates 40 or 140 and into the space having a cross-sectional distance "a" as shown in FIGS. 1 and 4, whereby $a=h_1$ and $m<a$. Since the length and thickness of the webs within the processing spools may likely be greater than the length and thickness of the image carrying medium 71 within the film cartridge 70, then the diameter $h_4$ of the processing spools may likely be greater than the diameter $h_3$ of a standard size 35 mm film cartridge. Thus, the spool caddy 1 is built to accommodate spools having various diameters. Moreover, the snap plates 40 and 140 are made of a flexible, resilient plastic which allows resilient spreading of the leaf sections 50 in the snap plate 40 and the claws 49 and 51 in the snap plate 140 during insertion or removal of the core 72. Once a processing spool is snapped into place in the spool caddy 1 as shown in FIG. 2, it is held there until a force is applied to remove the core 72 through the gap "m". The force required for inserting or removing the core 72 from either snap plate 40 or 140 is adjustable by changing the material from which the snap plate 40 or 140 is made, changing the thickness "z" of the snap plate 40 or 140, or by adjusting the length and width of a channel 47 for each arm 45 of the snap plate 140.

Figure 3D:
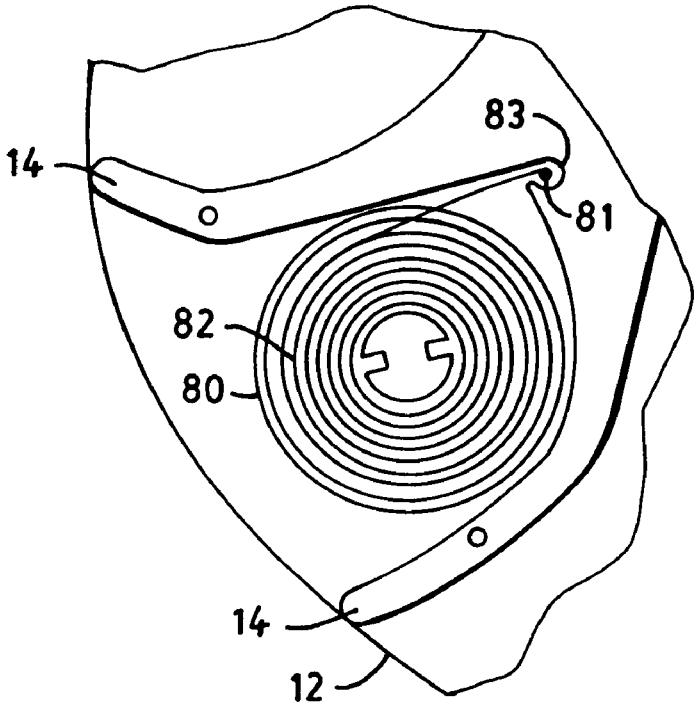
FIG. 3D is a top view illustrating one technique for attaching a web of a processing spool to the body of the spool caddy of FIG. 1.
Figure 3E:
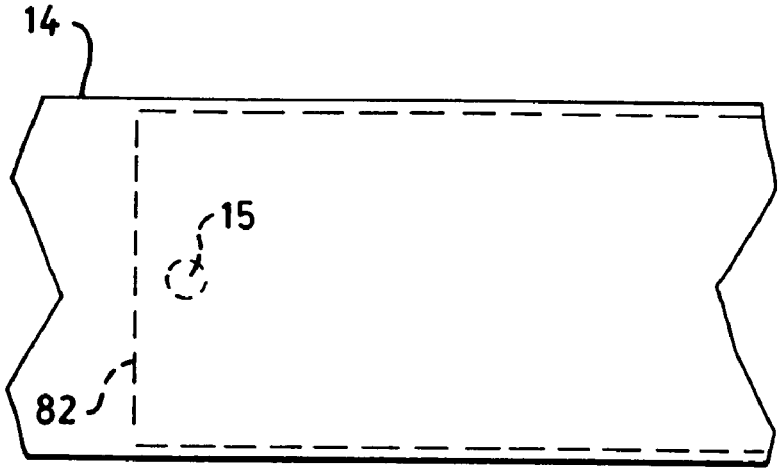
FIG. 3E is a side view illustrating another technique for attaching a web of a processing spool to the body of the spool caddy of FIG. 1.

Each processing spool contains a web having a protruding leader which is fixedly attached to one arm 14 of the caddy body 10 as shown in FIG. 3C. For example, the web 82 of spool 80 has a protruding leader 86 which is fixedly attached to one arm 14 at point 84. Alternatively, the web 82 can be secured to the body 10 as shown in FIG. 3D via a nub 81 located at the end of the web 82 which is inserted into a slot 83 during installation of the processing spool 80 into the spool caddy 1. FIG. 3E illustrates a web 82 connected to arm 14 via a rivet 15 which allows pivoting of the web 82 about the rivet 15 during unwinding and rewinding of the web 82 onto the spool 80. Any other known means can be used for fastening the web 82 to the body of the spool caddy.

In the embodiment of FIG. 3C, spool 80 is a developer spool which contains a reagent laden web 82 imbibed with developing chemicals; spool 90 is a blix (i.e. bleaching and fixing) spool which contains a reagent laden web 92 imbibed with a combination of bleaching and fixing chemicals; spool 100 is a wash spool which contains a web 102 soaked with a combination of washing and stabilizing agents; and spool 110 is a blotter spool which contains a web 112 of dry non-woven material.

The assembled spool caddy 1 contains the body 10, the snap plate 40, the binding lever 60, and the preselected processing spools. The number and contents of the processing spools of a particular spool caddy can vary according to the needs for processing a particular roll film. For instance, if separate bleaching and fixing steps are desired, then the blix spool 90 could be replaced by two separate spools, one containing a reagent laden web imbibed with bleaching chemicals, and the other containing a reagent laden web imbibed with fixing chemicals. The spool caddy 1 would then require six arms 14 and the snap plate 40 would require six leaf shaped sections 50.

Of course, processing spools with other processing capabilities could be added to the spool caddy 1 if desired. The number of arms 14 on the caddy body 10 and the number of leaf shaped sections 50 on the snap plate 40, or claws 45 on the snap plate 140, can change in accordance with the number of spools desired or required for film processing. Moreover, the arms 14 can take any desired shape as long as they provide both support for the various spools, and isolation of those spools from one another. Also, any snap plate design may be used that allows the snap plate to detachably hold each spool in place. Furthermore, the processing spools could be encased in hard shell cartridges, similar to 35 m cartridges, so that a snap plate could detachably retain the bodies of the hard shell processing cartridges, rather than the cores as described above.

A modified version of the above-described spool caddy 1 would house only the processing spools, i.e. the modified spool caddy 1 would not house the film cartridge 70. In this embodiment, the structural components of the spool caddy 1 which interact solely with the film 71 or the film cartridge 70 become unnecessary. In other words, the binding lever 60, the slot 24 and the cavity 20 would no longer be needed.

FIG. 8 is a perspective exploded view of a second embodiment of a spool caddy 200 which conforms to the principles of the present invention. The three major components of the spool caddy 200 are the body 202, the snap ring 206 and the binding lever 204. Each of the major components is preferably molded or otherwise made from a strong, inexpensive, lightweight material such as polystyrene or any other plastic. These components when assembled together form the spool caddy 200, shown assembled (without processing spools) in FIG. 9.

The operability of the three components 202, 204 and 206 is similar to that of the previously described parts 10, 60 and 40, respectively shown in the spool caddy 1 of FIG. 1. The body 200 is similar to the body 10 by functioning to detachably secure and support a group of processing spools, plus a film cartridge, in isolation from one another. The body 200 includes a base 210, a plurality of arms 208 and a cavity 212 positioned along the central longitudinal axis 218 of the spool caddy 200. The body 200 also includes a spacer section 219, located between two arms 208, which can be enlarged, diminished or eliminated as necessary to provide proper spacing and orientation of the desired number of processing spools to be mounted on the body 200.

The body 202 of the spool caddy 200 is a single molded piece which includes a plurality of claw-shaped arms 45 each having a pair of claws 49 and 51. A processing spool or film cartridge is installed onto the spool caddy 200 by snapping the core 72 of the selected spool between the claws 49 and 51 in the same manner as shown for the embodiment of FIG. 2. Alternatively, each selected spool can be mounted or removed from the body 202 via cutouts 214 which allow the bottom portion (opposite core 72) of the selected spool to be engaged by a mechanism (not shown) for removing or returning the selected spool from or to the spool caddy 200, respectively.

The inventive spool caddy as claimed and described herein in various embodiments can be used for pad processing any photographic roll film with a variety of image processing systems such as, but not limited to, the processing systems disclosed in Polaroid Case No. 8221 filed on even date herewith. The functionality of the spool caddy in cooperation with other elements of a pad processing system are described in detail in the above related patent application.

It is to be understood that the above described embodiments are merely illustrative of the present invention and represent a limited number of the possible specific embodiments that can provide applications of the principles of the invention. Numerous and varied other arrangements may be readily devised in accordance with these principles by those skilled in the art without departing from the spirit and scope of the invention as claimed.

What is claimed is:

1. A spool caddy processing apparatus for use with an optical dry image processor for processing a photographic roll film housed in a film cartridge, said spool caddy comprising:

a plurality of processing spools, each containing a reagent laden pad for providing a processing step when combined with an emulsion side of the film for a predetermined dwell time; and means for detachably securing and supporting each said processing spool in isolation from one another.

2. The spool caddy processing apparatus of claim 1, further comprising:

means for detachably securing and supporting the film cartridge in isolation from said processing spools; and means for detachably retaining a film leader of the film.

3. The spool caddy processing apparatus of claim 1, wherein said pad of each said processing spool is attached to said means for detachably securing and supporting each said processing spool.

4. The spool caddy processing apparatus of claim 1, further comprising means for enabling positional alignment of said spool caddy.

5. The spool caddy processing apparatus of claim 1, wherein said reagent laden pad in one of said plurality of spools is imbibed with a chemical for developing the film.

6. The spool caddy processing apparatus of claim 1, wherein said reagent laden pad in one of said plurality of spools is imbibed with a chemical for bleaching the film.

7. The spool caddy processing apparatus of claim 1, wherein said reagent laden pad in one of said plurality of spools is imbibed with a chemical for photographically fixing the film.

8. The spool caddy processing apparatus of claim 1, wherein said reagent laden pad in one of said plurality of spools includes washing material for washing the film.

9. The spool caddy processing apparatus of claim 1, wherein said plurality of processing spools further comprises a spool containing a web of non-woven blotter material for absorbing liquids.

10. A spool caddy processing apparatus for use with an optical dry image processor for processing a photographic roll film housed in a film cartridge, said spool caddy comprising:

a plurality of processing spools, each containing a reagent laden pad for providing a processing step when combined with an emulsion side of the film for a predetermined dwell time;

a body for supporting said processing spools and isolating each of said processing spools from one another; and a snap plate, connected to said body, for detachably retaining said processing spools.

11. The spool caddy processing apparatus of claim 10, further comprising a binding lever, cooperating with said body to detachably secure a film leader of said film.

12. The spool caddy processing apparatus of claim 10, wherein one end of said pad of each said processing spool is attached to said body.

13. The spool caddy processing apparatus of claim 10, wherein said body further comprises a notch for enabling positional alignment of said spool caddy.

14. The spool caddy processing apparatus of claim 10, wherein said reagent laden pad in one of said plurality of spools is imbibed with a chemical for developing the film.

15. The spool caddy processing apparatus of claim 10, wherein said reagent laden pad in one of said plurality of spools is imbibed with a chemical for bleaching the film.

16. The spool caddy processing apparatus of claim 10, wherein said reagent laden pad in one of said plurality of spools is imbibed with a chemical for fixing the film.

17. The spool caddy processing apparatus of claim 10, wherein said reagent laden pad in one of said plurality of spools includes washing material for washing the film.

18. The spool caddy processing apparatus of claim 10, wherein said plurality of processing spools further comprises a spool containing a web of non-woven blotter material for absorbing liquids.

* * * * *